US012251073B1

(12) United States Patent
Ebrahimi Afrouzi

(10) Patent No.: US 12,251,073 B1
(45) **Date of Patent: *Mar. 18, 2025**

(54) OSCILLATING SIDE BRUSH FOR MOBILE ROBOTIC VACUUM

(71) Applicant: Ali Ebrahimi Afrouzi, San Diego, CA (US)

(72) Inventor: Ali Ebrahimi Afrouzi, San Diego, CA (US)

(73) Assignee: AI Incorporated, Toronto (CA)

( * ) Notice: Subject to any disclaimer, the term of this patent is extended or adjusted under 35 U.S.C. 154(b) by 385 days.

This patent is subject to a terminal disclaimer.

(21) Appl. No.: 17/210,350

(22) Filed: Mar. 23, 2021

Related U.S. Application Data

(63) Continuation of application No. 15/924,176, filed on Mar. 17, 2018, now Pat. No. 10,980,385.

(60) Provisional application No. 62/544,273, filed on Aug. 11, 2017.

(51) Int. Cl.

| | |
|---|---|
| ***A47L 9/04*** | (2006.01) |
| ***A46B 13/02*** | (2006.01) |
| ***A47L 11/24*** | (2006.01) |

(52) U.S. Cl.
CPC ..... *A47L 9/0483* (2013.01); *A46B 13/026* (2013.01); *A47L 11/24* (2013.01)

(58) Field of Classification Search
CPC ..... A47L 11/32; A47L 11/325; A47L 11/33; A47L 9/2847; A47L 2201/06; A47L 9/0483; A47L 9/041; A46B 13/026
See application file for complete search history.

(56) References Cited

U.S. PATENT DOCUMENTS

| | | | | |
|---|---|---|---|---|
| 5,901,411 | A * | 5/1999 | Hato | A47L 9/0483 15/381 |
| 7,503,096 | B2 | 3/2009 | Lin | |
| 7,636,982 | B2 | 12/2009 | Jones | |
| 8,087,117 | B2 | 1/2012 | Kapoor | |
| 8,390,251 | B2 | 3/2013 | Cohen | |
| 8,584,305 | B2 | 11/2013 | Won | |
| 9,078,552 | B2 | 7/2015 | Han | |
| 9,931,008 | B2 * | 4/2018 | Yoo | A47L 11/4036 |
| 10,980,385 | B1 * | 4/2021 | Ebrahimi Afrouzi | A46B 13/026 |

* cited by examiner

*Primary Examiner* — Bryan R Muller

(57) ABSTRACT

Provided is a robotic cleaning device, including a chassis, an oscillating mechanism, and a cleaning component, wherein the oscillating mechanism causes the cleaning component to oscillate in at least plane parallel to a driving surface of the robotic cleaning device.

6 Claims, 11 Drawing Sheets

OSCILLATING SIDE BRUSH FOR MOBILE ROBOTIC VACUUM

CROSS REFERENCE TO RELATED APPLICATIONS

This application is a Continuation of U.S. Non-Provisional patent application Ser. No. 15/924,176, filed Mar. 17, 2018, which claims the benefit of U.S. Provisional Patent Application No. 62/544,273 filed Aug. 11, 2017, each of which is hereby incorporated by reference.

FIELD OF THE DISCLOSURE

The disclosure relates to robotic vacuums, and more particularly, to side brushes used by robotic vacuums.

BACKGROUND

During operation, robotic floor-cleaning devices may encounter obstructions that prevent the devices from properly completing their task. For example, side brushes generally extend beyond the body of the robotic vacuum to reach areas otherwise inaccessible by the main side brush. Because of this extension, the side brushes may be vulnerable to interaction with obstructions on the working surface. Conventional side brushes are configured as spinning side brushes. As such, conventionally spinning side brushes may tend to draw in obstructions, such as by wrapping up electrical cords or wires around the side brush. In addition to presenting a potentially hazardous condition, removing obstructions may require human intervention thereby reducing the level of autonomy of the robotic vacuum. As such, oscillating side brushes are presented herein.

SUMMARY

The following presents a simplified summary of some embodiments of the invention in order to provide a basic understanding of the invention. This summary is not an extensive overview of the invention. It is not intended to identify key/critical elements of the invention or to delineate the scope of the invention. Its sole purpose is to present some embodiments of the invention in a simplified form as a prelude to the more detailed description that is presented below.

Provided is a robotic cleaning device, including a chassis, an oscillating mechanism, and a cleaning component, wherein the oscillating mechanism causes the cleaning component to oscillate in at least plane parallel to a driving surface of the robotic cleaning device.

The features and advantages described in the specification are not all inclusive and, in particular, many additional features and advantages will be apparent to one of ordinary skill in the art in view of the drawings, specification, and claims. Moreover, it should be noted that the language used in the specification has been principally selected for readability and instructional purposes, and may not have been selected to delineate or circumscribe the inventive subject matter.

BRIEF DESCRIPTION OF THE DRAWINGS

Non-limiting and non-exhaustive features of the present invention are described with reference to the following figures, wherein like reference numerals refer to like parts throughout the various figures.

DETAILED DESCRIPTION OF SOME EMBODIMENTS

The present invention will now be described in detail with reference to a few embodiments thereof as illustrated in the accompanying drawings. In the following description, numerous specific details are set forth in order to provide a thorough understanding of the present invention. It will be apparent, however, to one skilled in the art, that the present invention may be practiced without some or all of these specific details. In other instances, well known process steps and/or structures have not been described in detail in order to not unnecessarily obscure the present invention.

In still other instances, specific numeric references such as "first material," may be made. However, the specific numeric reference should not be interpreted as a literal sequential order but rather interpreted that the "first material" is different than a "second material." Thus, the specific details set forth are merely exemplary. The specific details may be varied from and still be contemplated to be within the spirit and scope of the present disclosure. The term "coupled" is defined as meaning connected either directly to the component or indirectly to the component through another component. Further, as used herein, the terms "about," "approximately," or "substantially" for any numerical values or ranges indicate a suitable dimensional tolerance that allows the part or collection of components to function for its intended purpose as described herein.

The terms "certain embodiments", "an embodiment", "embodiment", "embodiments", "the embodiment", "the embodiments", "one or more embodiments", "some embodiments", and "one embodiment" mean one or more (but not all) embodiments unless expressly specified otherwise. The terms "including", "comprising", "having" and variations thereof mean "including but not limited to", unless expressly specified otherwise. The enumerated listing of items does not imply that any or all of the items are mutually exclusive, unless expressly specified otherwise. The terms "a", "an" and "the" mean "one or more", unless expressly specified otherwise.

The present invention proposes an oscillating mechanism with side brush for use with autonomous or semi-autonomous robotic devices. In a preferred embodiment, an autonomous or semi-autonomous mobile robotic vacuum cleaning device houses an oscillating mechanism to which a side brush is attached that extends beyond the body of the device. The side brush moves back and forth sweeping dust and debris towards the front of the robotic vacuum cleaning device so that the main brush is able to sweep up the dust and debris into the device. Entanglement is avoided because the oscillating side brush pushes obstructions aside as opposed to wrapping an obstruction around a spinning side brush as noted in conventional solutions above.

Figure 1:
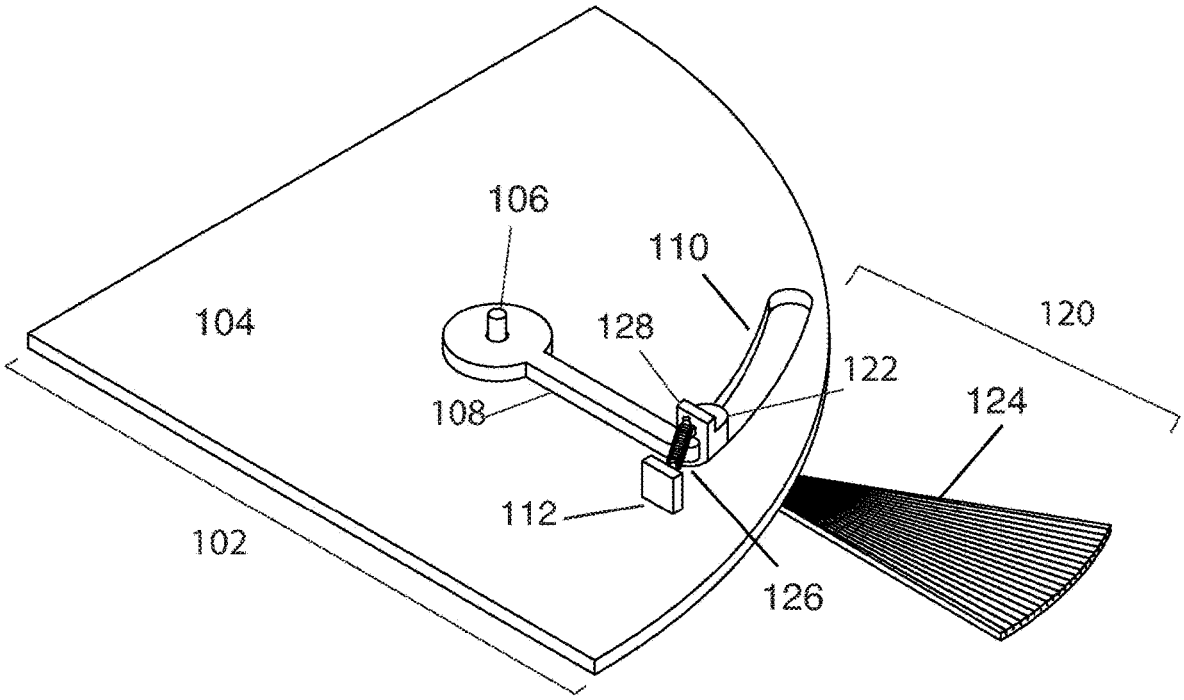
FIG. 1 illustrates a perspective view of an oscillating mechanism with side brush from above a base plate, according to some embodiments.

FIG. 1 illustrates a perspective view of an oscillating mechanism with side brush from above a base plate, according to some embodiments. As illustrated, base assembly 102 includes: base plate 104, rotating axle 106, arm 108, slot 110, and 102. In embodiments, the base plate illustrated may represent a portion of a larger base plate and may be mechanically coupled with a robotic chassis. Rotating axle 106 may extend perpendicularly from base plate 104. In embodiments, rotating axle may be motor driven by a main motor or a dedicated motor. In some embodiments, rotating axle is indirectly driven (i.e. belt driven) by a drive assembly while in other embodiments, rotating axle is directly driven by a drive assembly. Rotating axle 106 may be coupled with arm 108, which defines a path along which slot 110 may be positioned. Base assembly 102 further includes anchor 112 positioned along a proximal end of slot 110.

Further illustrated is brush assembly 120 that is slidingly coupled with base assembly 102. As may be seen, brush assembly 120 may move along slot 110 when engaged by arm 108. Brush assembly 120 includes hub 122, side brush 124, anchor 128, and return spring 126. In embodiments, hub 122 is slidingly coupled with base plate 104 along slot 110. In some embodiments, a lubricant may be provided to reduce friction. In other embodiments, an ultra-high molecular weight polymer may be utilized to reduce friction. As illustrated, side brush 124 may be coupled with hub 122 and extend outwardly from base 104. In embodiments, the side brush may extend beyond a cover of a robotic vacuum device. In embodiments, the side brush may extend beyond the cover of a robotic vacuum device up to approximately 2.0 inches. In some embodiments, the side brush includes a number of bristles that may be positioned along a plane. In other embodiments, the side brush includes a number of bristles that may be bundled together. Anchor 128 may be positioned along hub 122 and coupled with return spring 126, which in turn may be coupled with anchor 112.

Figure 2:
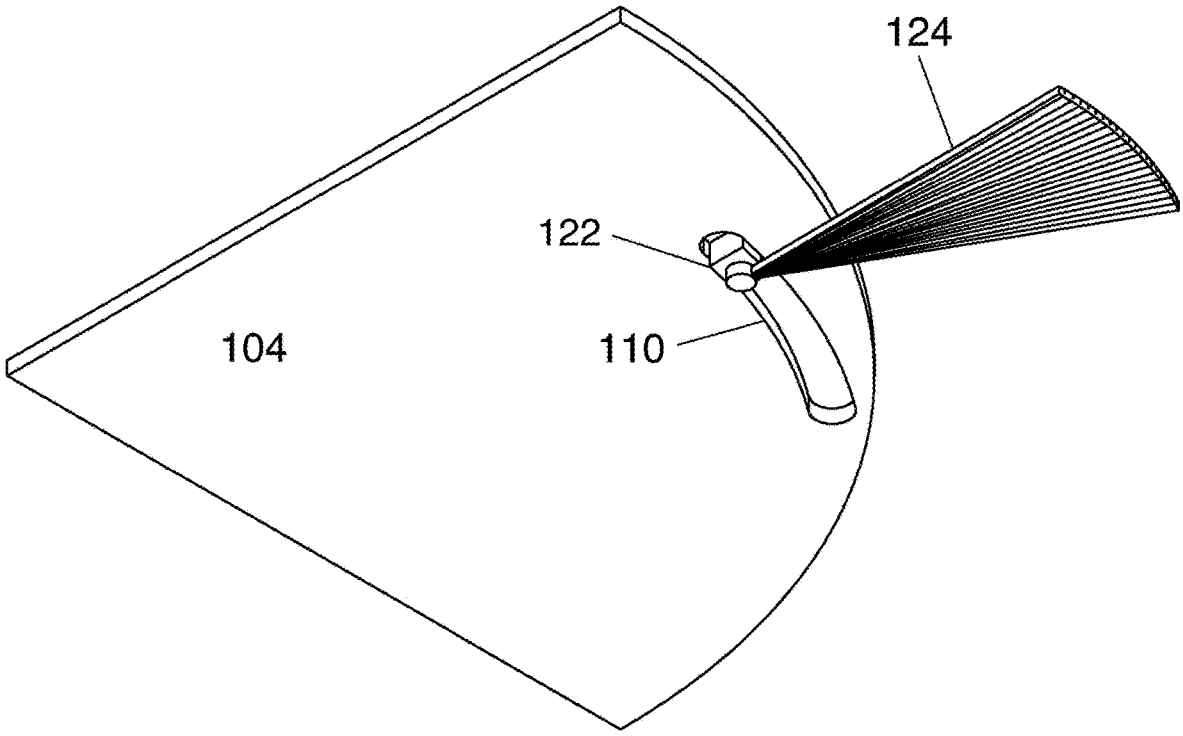
FIG. 2 illustrates a perspective view of an oscillating mechanism with side brush, from below a base plate, according to some embodiments.

FIG. 2 illustrates a perspective view of an oscillating mechanism with side brush, from below a base plate, according to some embodiments. As illustrated, base plate 104 includes slot 110. It may be seen that side brush 124 may be coupled with hub 122 and extend outwardly from base plate 104. It may be appreciated that anchors 112 and 128 of FIG. 1 are illustrated as positioned along a top surface of base plate 104. However, in some embodiments anchors may be equally positioned along a bottom surface of base plates as shown.

Figure 3A:
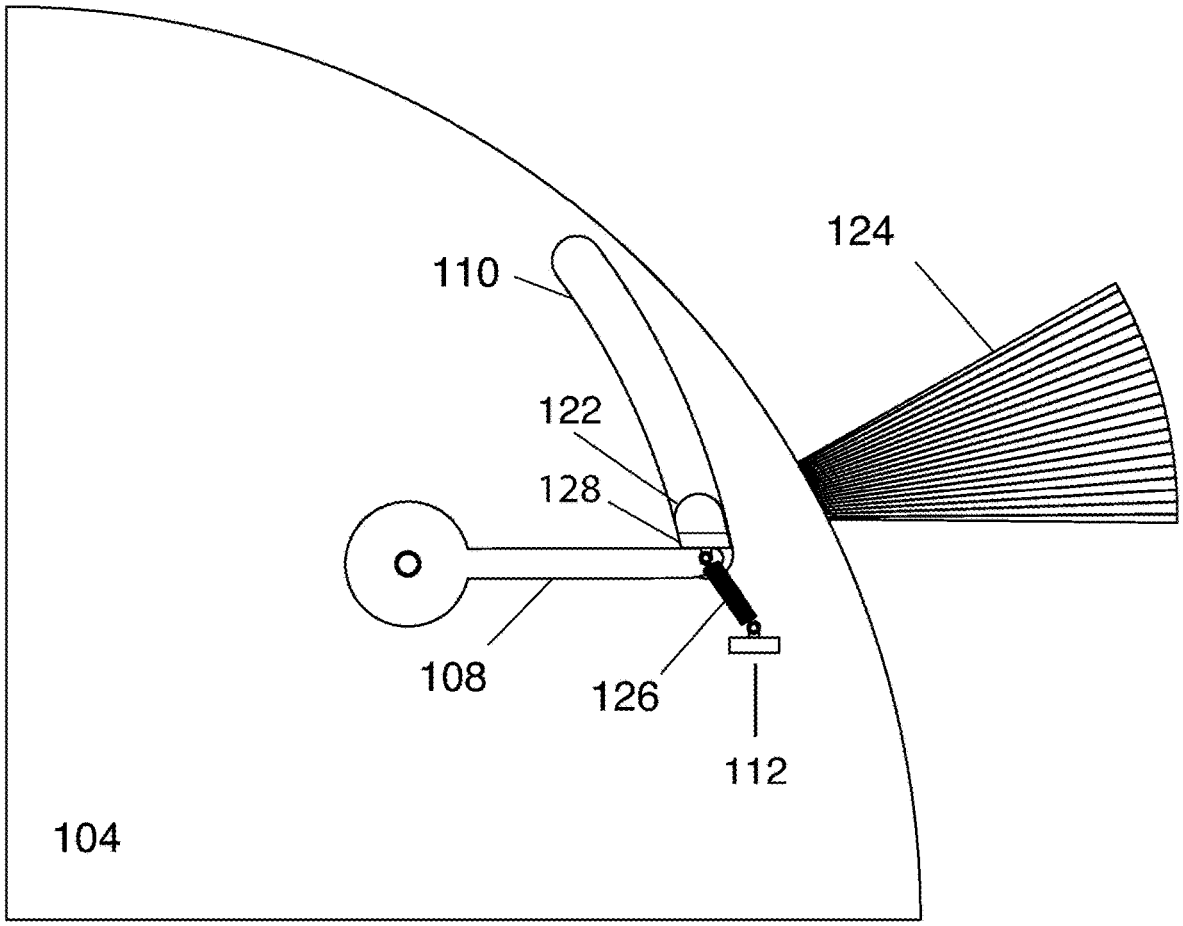
FIGS. 3A-E illustrate exemplary operations of an oscillating mechanism with side brush, according to some embodiments.
Figure 3B:
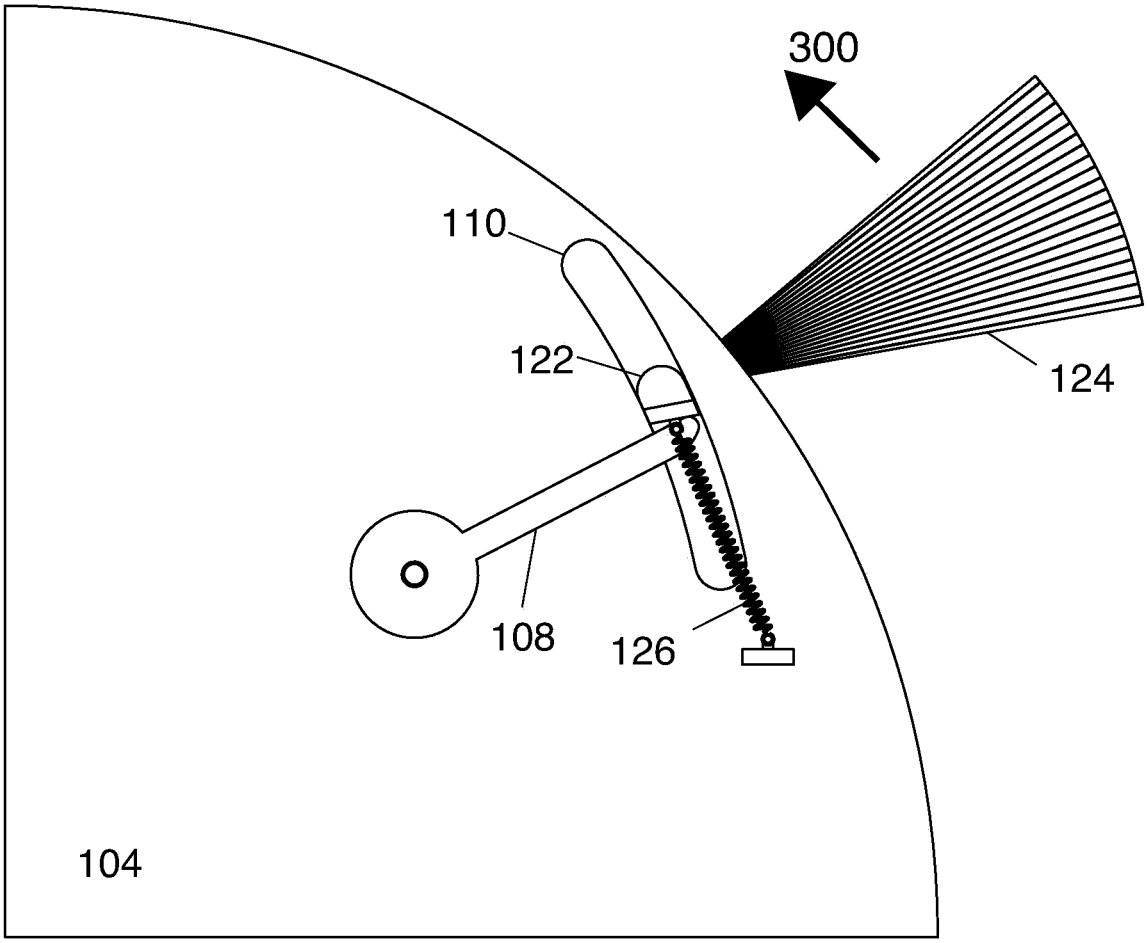

FIGS. 3A-E illustrate exemplary operations of an oscillating mechanism with side brush, according to some embodiments. In the embodiment shown in FIG. 3A an initial contact position of arm 108 with hub 122 is illustrated. In this position, hub 122 is positioned at a proximal end of slot 110. In addition, return spring 126 is coupled with anchor 112 and anchor 128 and is in a relaxed or substantially relaxed state. In some embodiments, in this position, return springs may be in a slightly extended state. Side brush 124 is shown extending outwardly from base plate 104. In some embodiments, side brushes extend at an angle of approximately 90°+/−45° from vertical as currently illustrated. Turning to FIG. 3B, the operation illustrates a position of hub 122 at approximately the middle of slot 110. As may be seen, arm 108 has traveled in substantially circular motion while engaging hub 122. Spring 126 is in a partially extended state. Side brush 124 extends from base plate 104 at substantially the same angle. That is, in embodiments, hub 122 does not generally rotate in slot 110 to present a different side brush angle during travel. Rather the side brush angle is generally maintained throughout the travel. This may provide a desired advantage to pushing debris forward as side brush 124 moves in direction 300.

Figure 3C:
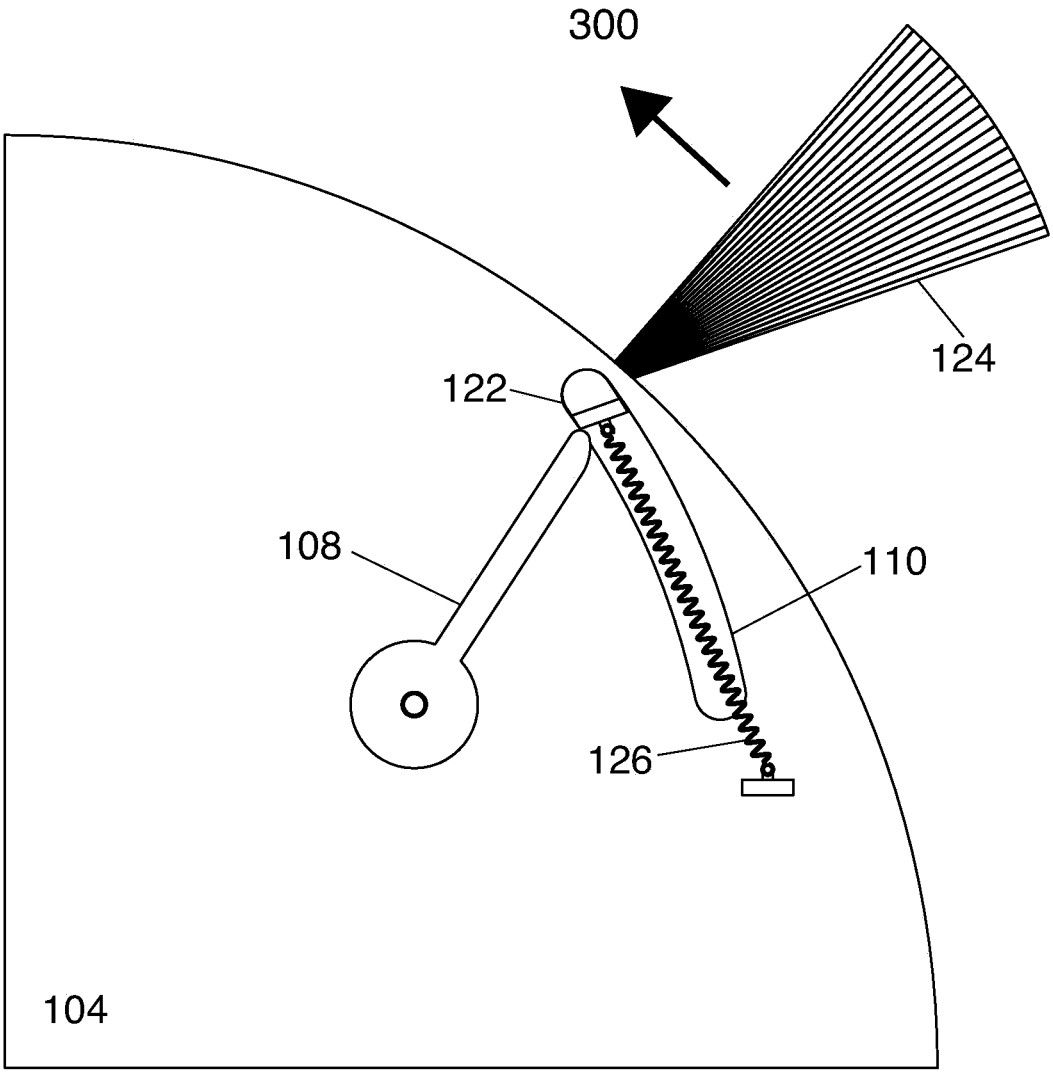
Figure 3D:
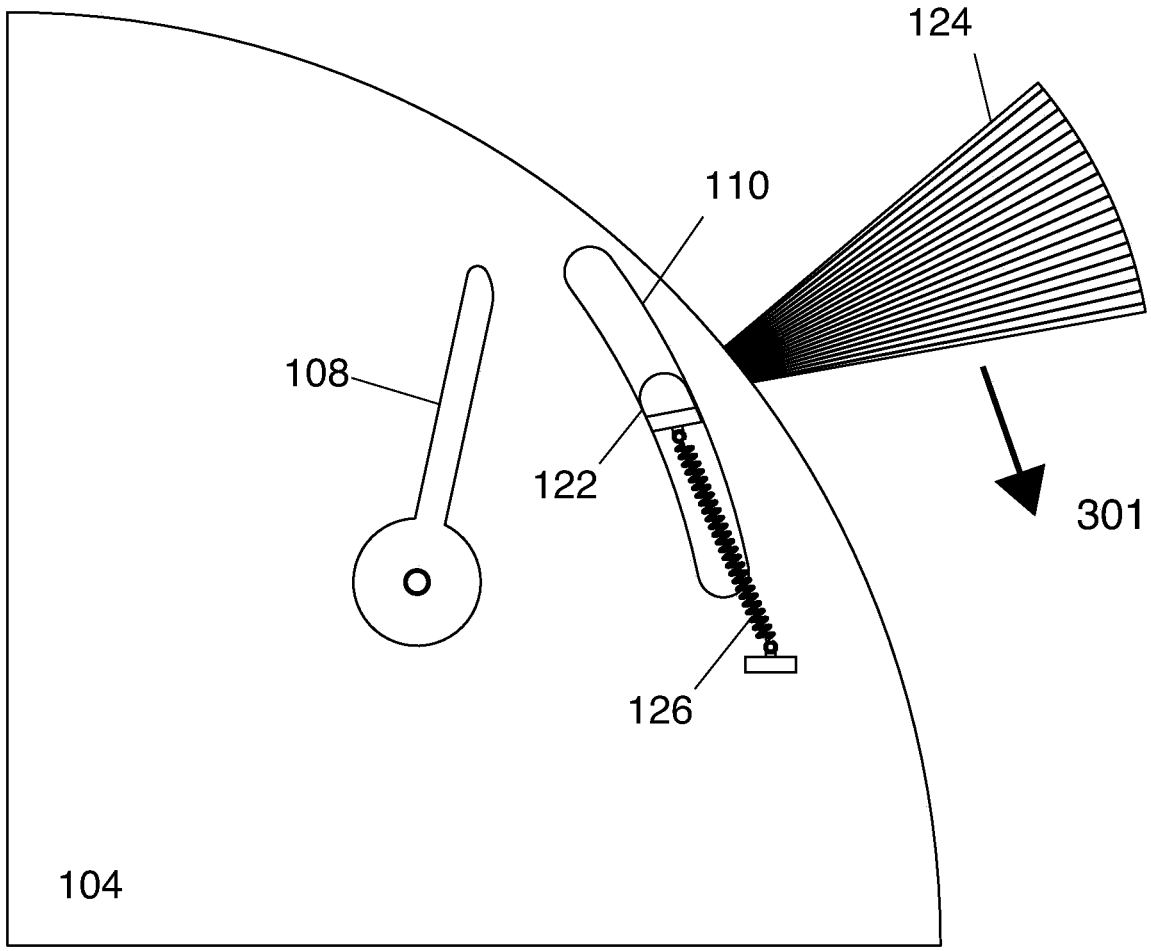
Figure 3E:
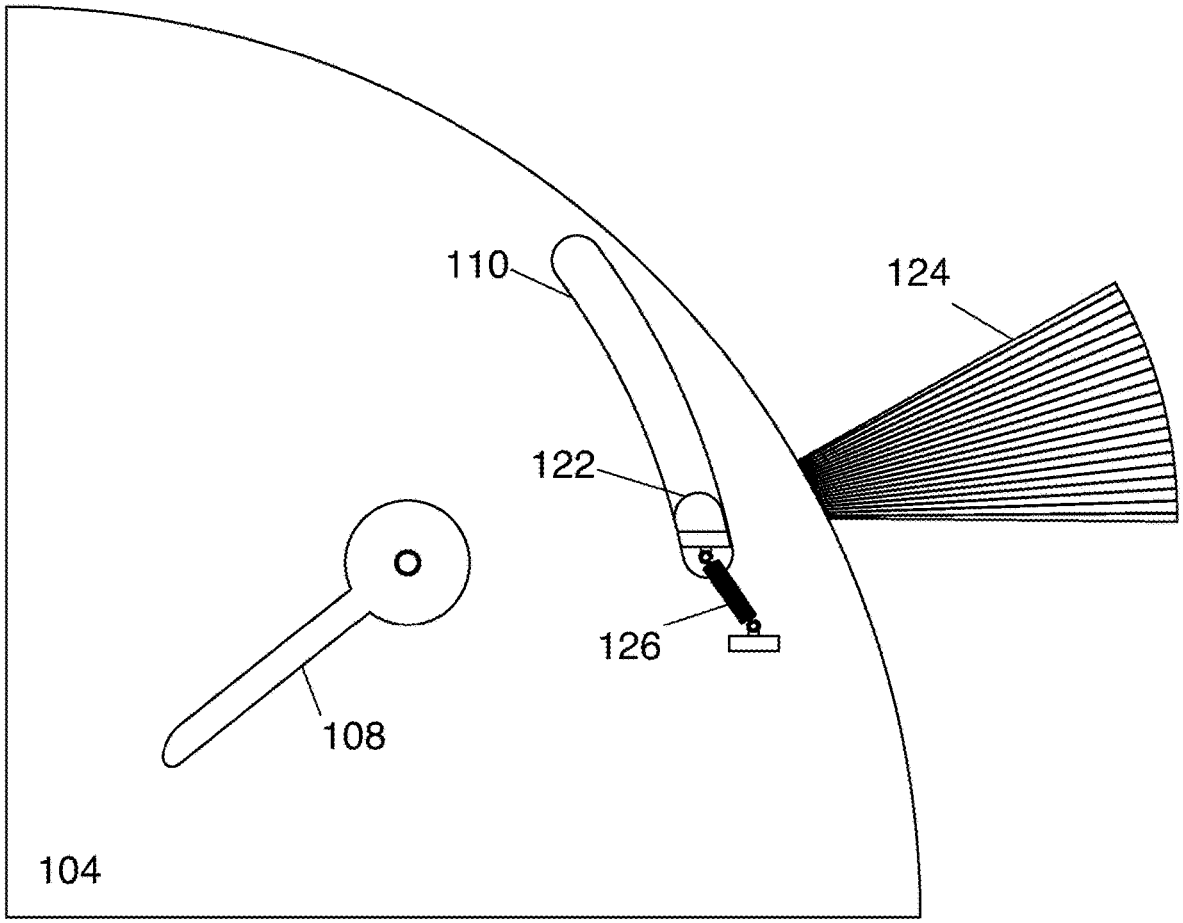

Turning to FIG. 3C, the operation illustrates a position of hub 122 near the end of slot 110. As may be seen, arm 108 has continued to travel in a circular motion while engaging hub 122. Spring 126 is in a fully extended state. Side brush 124 extends from base plate 104 at the same angle. That is, in embodiments, hub 122 does not generally rotate in slot 110 to present a different side brush angle during travel, however, some small rotation may be experienced in some embodiments. Rather the side brush angle is generally maintained throughout the travel. This may provide a desired advantage to pushing debris forward as side brush 124 moves in direction 300. Proceeding to FIG. 3D, the operation illustrates a position of hub 122 returning along slot 110 while arm 108 is disengaged from hub 122. Spring 126 is in an extended state and is retracting. Side brush 124 extends from base plate 104 at the same angle as it moves in direction 301. Turning to FIG. 3E, the operation illustrates a position of hub 122 at the initial position while arm 108 is disengaged from hub 122. As may be seen, arm 108 continues to rotate and will reengage hub 122 at the initial contact position.

It may be appreciated that the speed at which the hub returns to initial contact position is greater than the speed at which the arm moves the hub along the slot. The hub essentially "snaps" back to the initial contact or resting position. This action may provide a desired effect of reducing the amount of debris thrown backward while the side brush is returning to its resting position. The forward speed of the hub and side brush is dependent on the rotational speed of the axle. In some embodiments, the speed of the axle may be selected to correspond to the speed of the robotic vacuum device. In other embodiments, the speed of the axle may be independent of the speed of the robotic vacuum device.

Furthermore, although one arm is illustrated, one skilled in the art will recognize that embodiments may easily include two arms positioned at least 90° apart from each other effectively doubling the oscillation of side brush embodiments. In other embodiments, two or more arms equidistantly placed may be utilized. In addition, the illustrated operation shows the arm moving in a counter clockwise rotation. However, embodiments may also be configured utilizing a clockwise rotation without limitation. In some embodiments, more than one oscillating side brush mechanism may be implemented with the robotic vacuum device.

Figure 4:
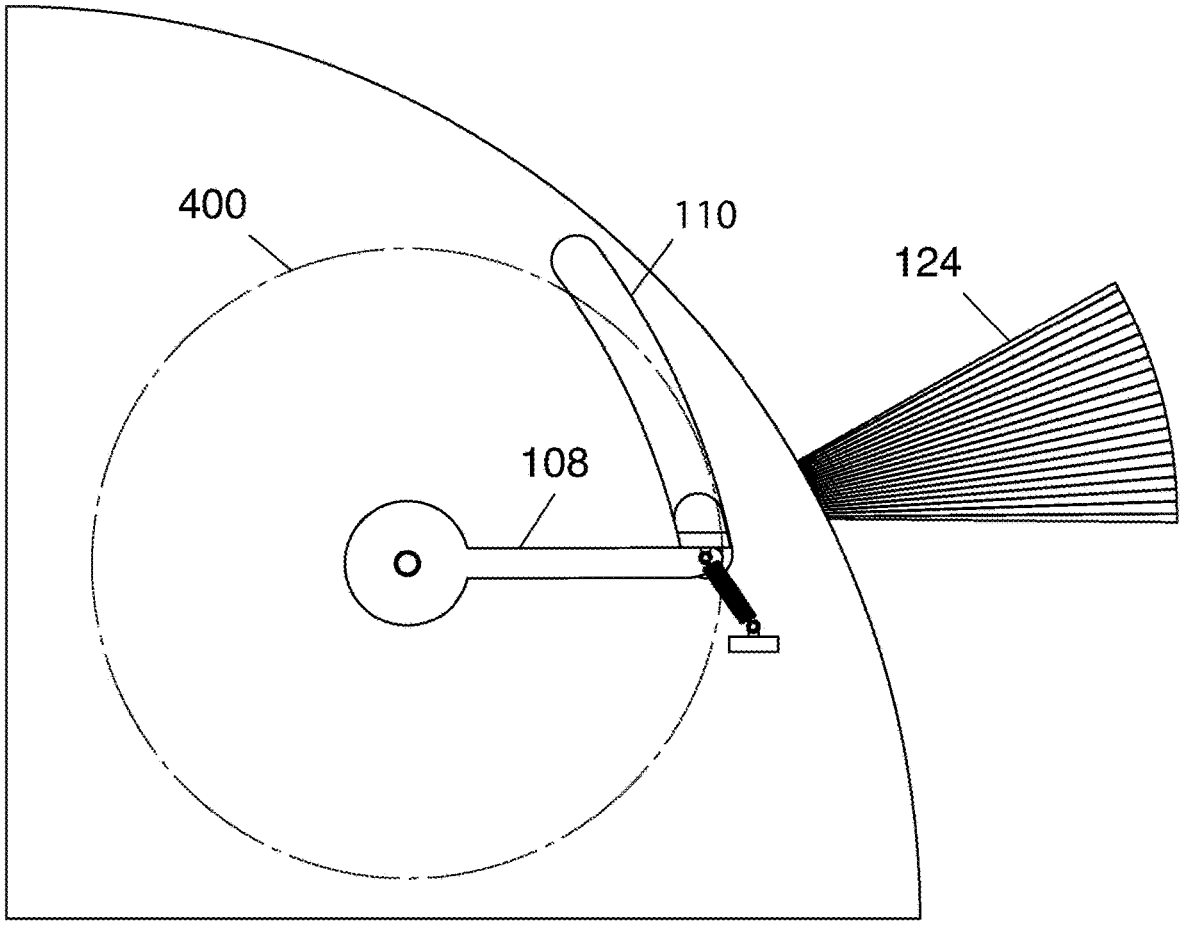
FIG. 4 illustrates a top view of a circular path of an oscillating mechanism with side brush, according to some embodiments.

FIG. 4 illustrates a top view of an oscillating mechanism with side brush, according to some embodiments. As may be seen, arm 108 travels through circular path 400 to move side brush 124 along the path of slot 110. In some embodiments, circular path 400 and slot 110 are not co-axial. In other embodiments, path 400 and slot 110 do share the same arcuate path. In still other embodiments, slot 110 is straight. In still other embodiments, the arm engages the hub in less than 90° of movement of the arm.

Figure 5:
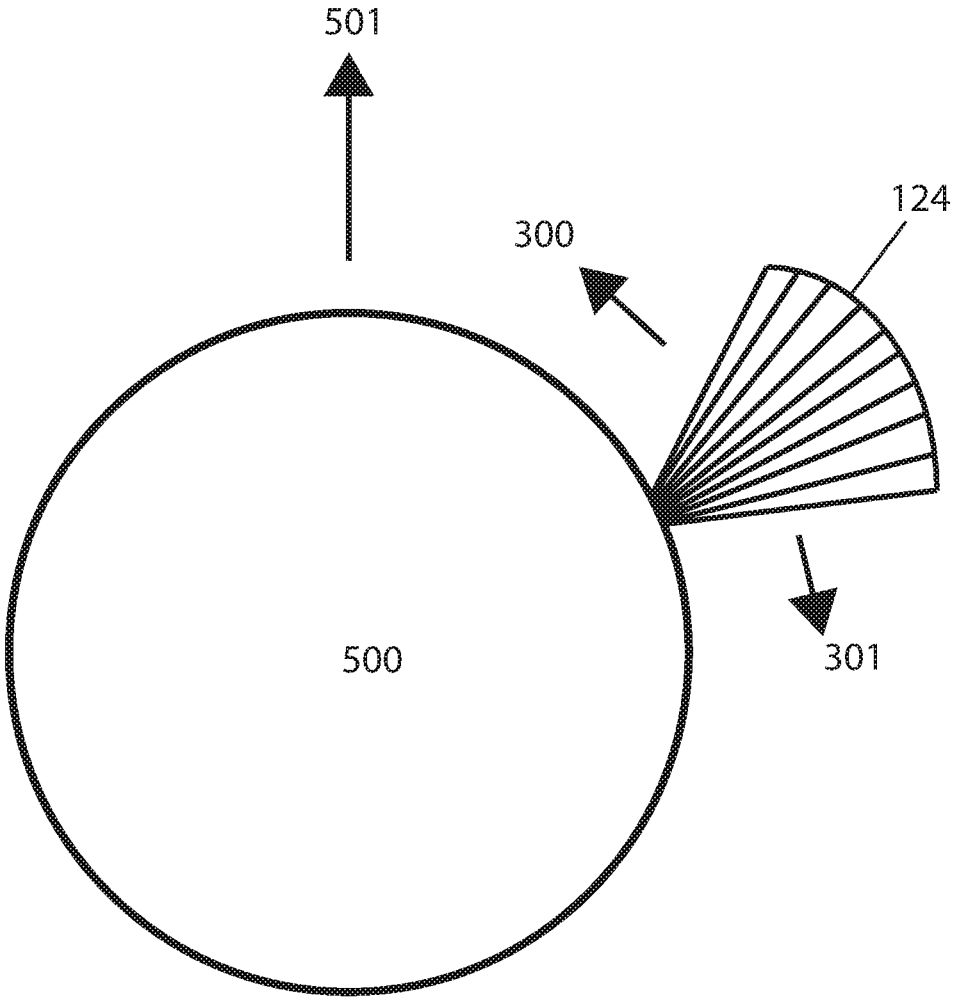
FIG. 5 illustrates a top view of a robotic vacuum device employing an oscillating side brush, according to some embodiments.

FIG. 5 illustrates a top view of a robotic vacuum device employing an oscillating side brush, according to some embodiments. In embodiments, a robotic vacuum device chassis may support the oscillating mechanism with side brush. As illustrated, while robotic vacuum device 500 moves in direction 501, side brush 124 sweeps forward in direction 300 and snaps back in direction 301 to an initial position. In this manner, debris may be swept forward to a main brush of robotic vacuum device 500.

Alternative Embodiments

Figure 6:
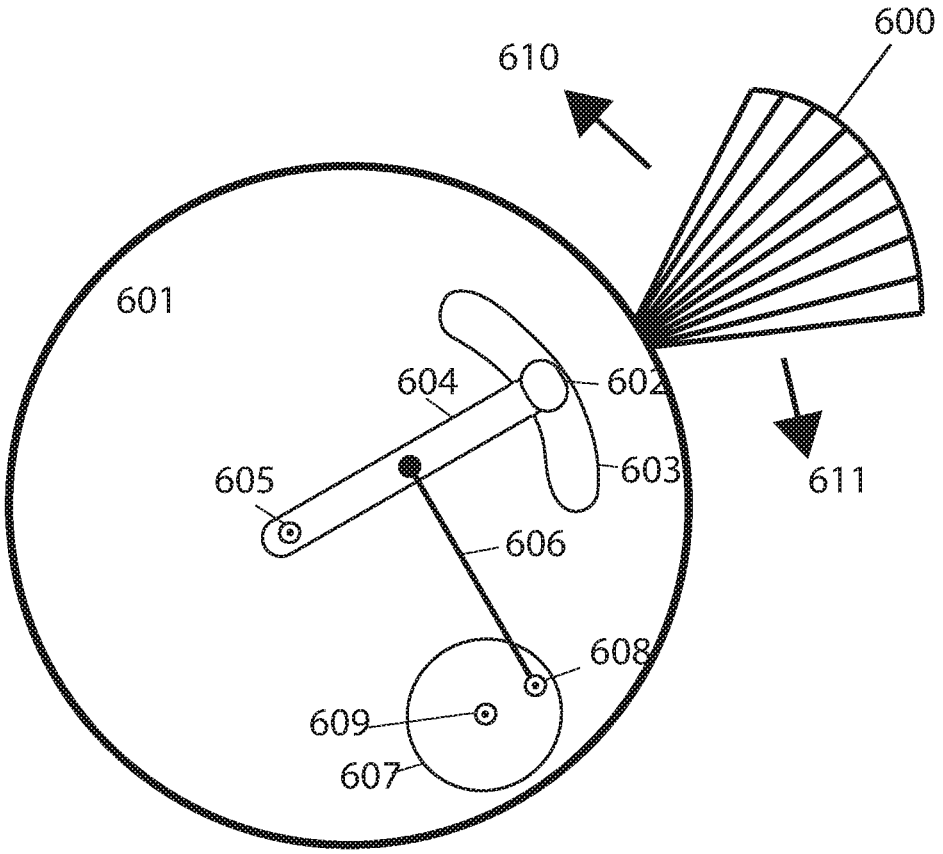
FIG. 6 illustrates a top view of an alternative oscillating mechanism with side brush, according to some embodiments.

FIG. 6 illustrates a top view of an alternative oscillating mechanism with side brush, according to some embodiments. As illustrated, side brush 600 extends from base plate 601 and is coupled with hub 602, which is limited to movement along slot 603 in base plate 601. Hub 602, in turn, may be coupled to arm 604. Arm 604 may be pinned to base plate 601 and can pivot about axle 605. As shown, linking member 606 is fixedly coupled with arm 604 on one end and coupled with wheel 607 on the other end such that that linking member 606 may rotate about pin connection 608. Wheel 607 is rotatably coupled at its center with base plate 601 and can rotate about axle 609. As wheel 607 rotates, linking member 606 moves arm 604 in forward direction 610 and returns arm 604 in reverse direction 611 along slot 603. As arm 604 moves back and forth along slot 603, hub 602 and attached side brush 600 oscillate back and forth. In embodiments, wheel 607 may be rotated using a motor or mechanically by, for example, rotation of the drive wheels.

Figure 7:
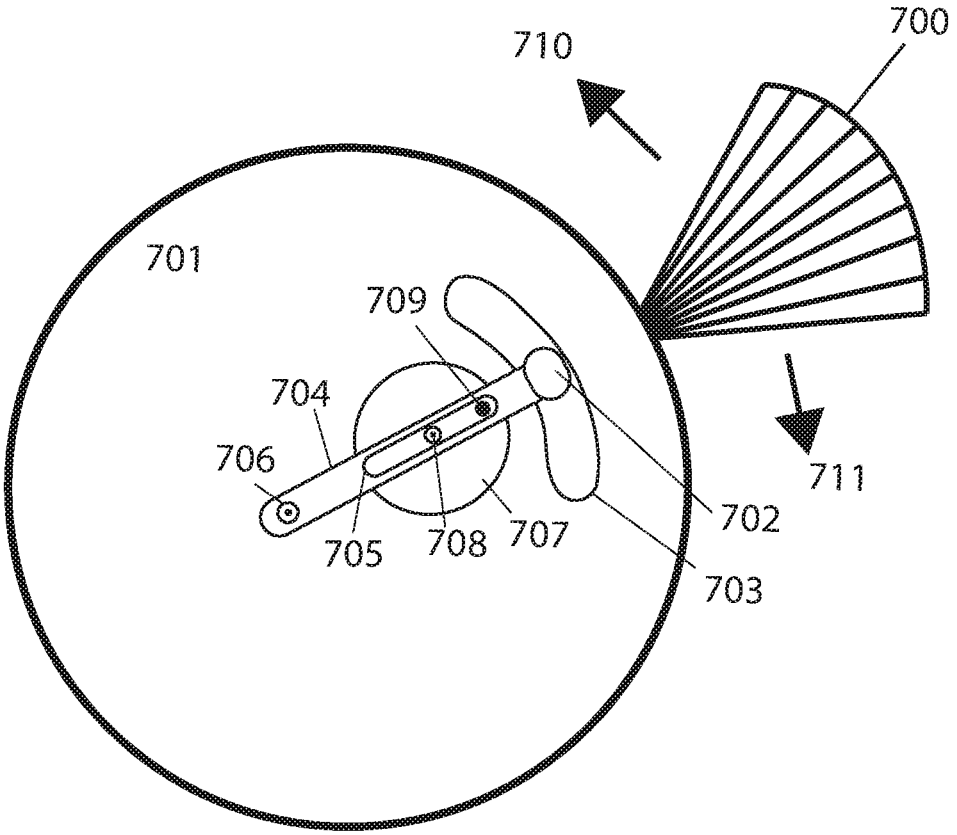
FIG. 7 illustrates a top view of an alternative oscillating mechanism with side brush, according to some embodiments.

FIG. 7 illustrates a top view of an alternative oscillating mechanism with side brush, according to some embodiments. As illustrated, side brush 700 extends from base plate 701 and is coupled with hub 702, which is limited to movement along slot 703. Hub 702, in turn, may be coupled with arm 704. Arm 704 includes slot 705 and arm 704 may pivot about a pinned point 706 and coupled with base plate 701. The center of wheel 707 is pinned to base plate 701 and can rotate about centered pinned point 708. Wheel 707 includes protruding member 709 extending outwards from the surface of the wheel 707. Wheel 707 is positioned such that protruding member 709 fits within slot 705 of arm 704. When wheel 707 rotates, attached protruding member 709 rotates as well. As protruding member 708 rotates it pushes and pulls arm 704 in direction 710 and 711 as protruding member 709 moves along slot 705, thereby moving hub 702 with attached bristles 700 back and forth along slot 703 in base plate 701. Wheel 707 may be rotated using a motor or mechanically by, for example, rotation of the wheels.

While this invention has been described in terms of several embodiments, there are alterations, permutations, and equivalents, which fall within the scope of this invention. It should also be noted that there are many alternative ways of implementing the methods and apparatuses of the present invention. Furthermore, unless explicitly stated, any method embodiments described herein are not constrained to a particular order or sequence. Further, the Abstract is provided herein for convenience and should not be employed to construe or limit the overall invention, which is expressed in the claims. It is therefore intended that the following appended claims be interpreted as including all such alterations, permutations, and equivalents as fall within the true spirit and scope of the present invention.

The invention claimed is:

1. A robotic cleaning device, comprising:
a chassis;
an oscillating mechanism; and
a cleaning component assembly;
wherein:
the oscillating mechanism causes the cleaning component to oscillate in at least a plane parallel to a surface on which the robotic cleaning device drives, wherein the oscillating mechanism comprises:
a rotating axle extending perpendicularly inwards within the chassis from a bottom surface of the robotic cleaning device;
at least one arm coupled to the rotating axle; and
a return spring attached to the cleaning component on a first end of the return spring and the chassis on a second end of the return spring, wherein:
the cleaning component assembly is slidingly coupled with the bottom surface of the robotic cleaning device;
during rotation of the axle, the at least one arm moves the cleaning component from a first position to a second position and, once the at least one arm is no longer in contact with the cleaning component, the return spring returns the cleaning component from the second position to the first position; and
alternating movement of the cleaning component by the at least one arm via the rotating axle and a spring force of the return spring causes the oscillation of the cleaning component; and
the cleaning component rotates about an axis perpendicular to the surface on which the robotic cleaning device drives.

2. The robotic cleaning device of claim 1, wherein;
the oscillating mechanism further comprises:
a slot along a path of the at least one arm;
a first anchor positioned adjacent to a proximal end of the slot; and
the cleaning component assembly slidingly coupled with the bottom surface of the robotic cleaning device, comprising:
a hub slidingly coupled with the bottom surface of the robotic cleaning device within the slot;
the cleaning component coupled with the hub;
a second anchor positioned on a side of the hub; and
a return spring coupled with the first anchor and the second anchor;
wherein:
during rotation of the axle, the at least one arm contacts the hub to move the cleaning component along the slot from a first position to a second position and, once the at least one arm is no longer in contact with the hub, the return spring returns the cleaning component along the slot from the second position to the first position; and
alternating movement of the cleaning component by the at least one arm via the rotating axle and a spring force of the return spring causes the oscillation of the cleaning component.

3. The robotic cleaning device of claim 1, wherein the oscillating mechanism comprises a drive assembly that provides rotational force to at least one rotating axle.

4. The robotic cleaning device of claim 1, wherein the cleaning component is oriented parallel to the surface on which the robotic cleaning device drives.

5. The robotic cleaning device of claim 1, wherein the cleaning component moves dust and debris of the surface of the robotic cleaning device.

6. The robotic cleaning device of claim 1, further comprising at least one other oscillating mechanism.

* * * * *